US006629431B1

(12) United States Patent
Robertson

(10) Patent No.: US 6,629,431 B1
(45) Date of Patent: Oct. 7, 2003

(54) PEDESTAL COOLER WITH COASTER BASE

(75) Inventor: James D. Robertson, Atlanta, GA (US)

(73) Assignee: Display Industries, LLC., Norcross, GA (US)

( * ) Notice: Subject to any disclaimer, the term of this patent is extended or adjusted under 35 U.S.C. 154(b) by 0 days.

(21) Appl. No.: 10/185,373

(22) Filed: Jun. 28, 2002

(51) Int. Cl.[7] ..... F25D 3/08
(52) U.S. Cl. ..... 62/457.6; 220/592.17
(58) Field of Search ..... 62/457.4, 457.6; 220/592.17, 592.25, 592.27, 670, 672, 675, 669, 635, 703, 848

(56) References Cited

U.S. PATENT DOCUMENTS 419,378 A * 1/1890 Madden ..... D7/510
1,393,235 A * 10/1921 Mitrovich ..... 215/6
3,765,559 A * 10/1973 Sauey et al. ..... 220/592.16
3,766,975 A * 10/1973 Todd ..... 165/74
5,090,213 A * 2/1992 Glassman ..... 62/457.3
5,437,165 A * 8/1995 White et al. ..... 62/465
5,918,761 A * 7/1999 Wissinger ..... 220/713
5,975,337 A * 11/1999 Hadley ..... 220/592.17
6,105,809 A * 8/2000 Yamanaka ..... 220/326
6,363,740 B1 * 4/2002 Hansen ..... 62/457.5
6,367,652 B1 * 4/2002 Toida et al. ..... 220/739

* cited by examiner

*Primary Examiner*—William E. Tapolcai
*Assistant Examiner*—Mohammad M. Ali
(74) *Attorney, Agent, or Firm*—John L. James

(57) ABSTRACT

A cooler for cooling individual beverage containers and the liquid therein using ice has a pedestal fastened to a coaster base. The pedestal has a truncated bell shape and is wider at its top than at its bottom The top portion of the pedestal contains a tub. A dome shaped lid is attached to the top portion of the pedestal. When the lid is closed, the lid covers the tub.

7 Claims, 8 Drawing Sheets

PEDESTAL COOLER WITH COASTER BASE

CROSS-REFERENCE TO RELATED APPLICATIONS

This application is related to my application Ser. No. 29/163,237 filed Jun. 28, 2002.

TECHNICAL FIELD OF THE INVENTION

This invention relates generally to a cooler for beverage containers, and, more particularly, to a cooler that holds ice for cooling the beverage containers and the liquid therein.

BACKGROUND OF THE INVENTION

Beverages are routinely served chilled, poured over ice and sometimes even chilled beverages are still served over ice. Many people desire beverages served very cold in what is often termed an ice cold condition. Establishments that merchandise individual beverage servings typically have refrigerator units that chill the beverage containers and the beverage therein using cold circulating air. There are many different brands and varieties beverages each vying for precious refrigerator shelf space and each vying for that shelf location that makes them the most visible and likely to be noticed. Refrigerator units are typically installed along a wall for easy electrical and mechanical connection, to keep the electrical and mechanical components out of sight, and for easy filling from the rear without disturbing customers. Unfortunately, this placement along a wall is problematic because it decreases product visibility. Also, sales are sometimes lost because the product does not look cold in the refrigerator or feel very cold to the touch.

Sometimes, a cooler filled with ice is used for dispensing beverages because it does not have to be positioned against a wall and therefore has a position advantage. While a typical cooler enjoys a position advantage, it adds nothing in a merchandising sense because it merely acts as a repository without aesthetically enhancing the product or making the product identification more visible. Accordingly, it will be appreciated that it would be highly desirable to have a cooler that enhances product visibility and merchantability.

SUMMARY OF THE INVENTION

The present invention is directed to overcoming one or more of the problems set forth above. Briefly summarized, according to present the invention, a cooler for beverage containers comprises a base, a pedestal upstanding from the base and a lid connected to the pedestal. The pedestal has top and bottom portions and the bottom portion is fastened to the base. The top portion defines a reservoir adapted to receive and hold the beverage containers. The lid is connected to the top portion and is operable between a closed position at which the lid covers the reservoir blocking access to the beverage containers and an open position at which access to the beverage containers is permitted.

The reservoir holds ice and beverage containers giving the appearance of being very cold. The reservoir is formed by an inner sidewall that is inside an outer sidewall with an air space between the two. The air space forms an insulator between the two sidewalls. When the outer sidewall is opaque, the air space can be filled with thermal insulation for greater effectiveness.

The pedestal has a curved configuration resembling a truncated bell or top half of an hour glass that provides aesthetic appeal. The base is wider than the bottom of the pedestal that rests on the base for added stability. The lid can be frosted to add to the aesthetic appeal. Also, the pedestal can have formed thereon small protrusions resembling drops of condensation giving the impression that it is icy cold.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
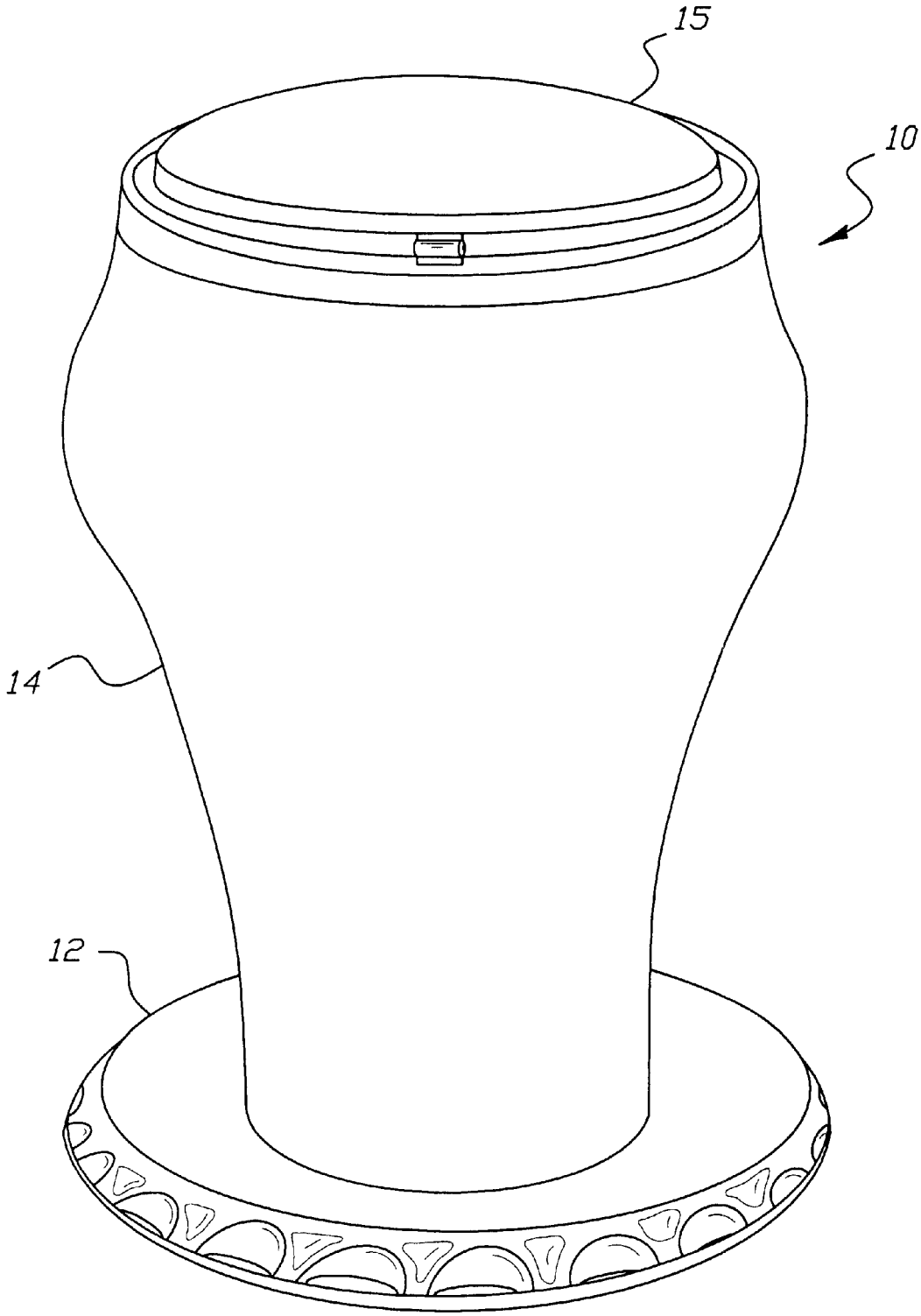
FIG. 1 is a front view of a preferred embodiment of a pedestal beverage cooler with the lid closed according to the present invention.

Referring to FIG. 1, a cooler 10 receives a plurality of beverage containers, such as bottles and cans, for display within easy reach of a consumer. The beverage containers are mingled with ice, preferably crushed ice, for cooling the containers. The cooler 10 may have a drain for removing melted ice, but construction is simpler without a drain. The more rapid the turnover of beverage containers, the less noticeable is the lack of a drain because some liquid is removed with each container leaving very little liquid to be manually removed.

Figure 2:
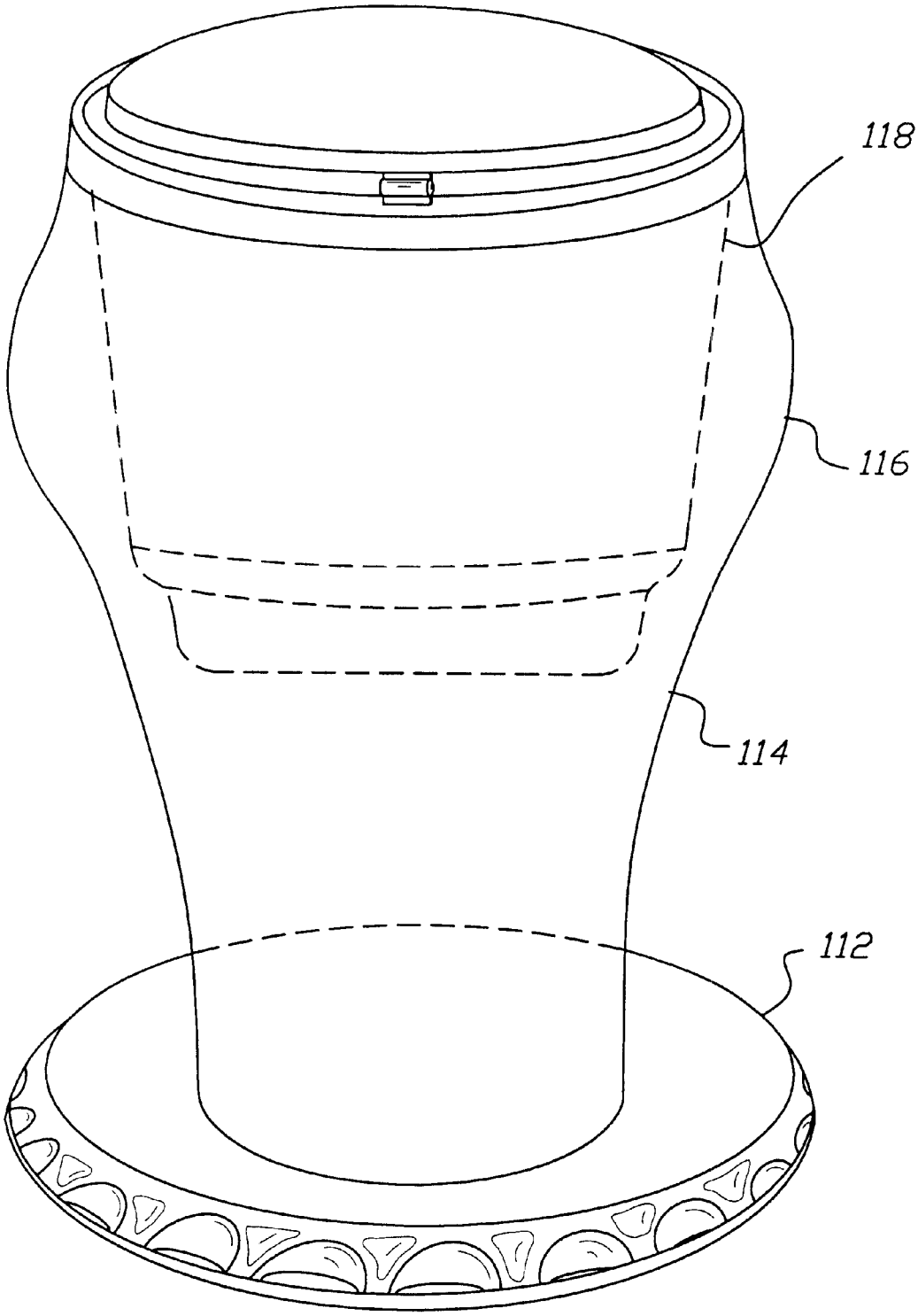
FIG. 2 is a is a front view of another preferred embodiment of a pedestal beverage cooler similar to FIG. 1 but having a transparent pedestal.

The cooler 10 has a base 12 and a pedestal 14 mounted on the base 12. As illustrated, the base 12 is a circular disk with a scalloped peripheral edge simulating the appearance of a cap on a bottle. While a circular disk configuration is preferred, other, noncircular configurations will function as well although perhaps with less aesthetic appeal. The pedestal 14 is constructed of opaque plastic material. Alternatively, as shown in FIG. 2, a cooler may have a base 112 and pedestal 114 that are transparent so that the rear of base 112 is visible through pedestal 114. An inner sidewall 118 that forms a reservoir is also visible through outer sidewall 116 of transparent pedestal 114.

The vertical pedestal 14 has a bottom portion upstanding from the base 12 and a top portion extending upward from the bottom portion. The bottom portion is fastened to the base by ultrasonic welding or other plastic welding technique, or with an adhesive or other bonding agent, such as an epoxy or cyanoacrylate. Of course, if the pedestal is opaque, then screws or other similar fasteners can be used without detracting from the aesthetics. The top portion of the vertical pedestal defines a reservoir adapted to receive and hold the beverage containers and ice.

Figure 3:
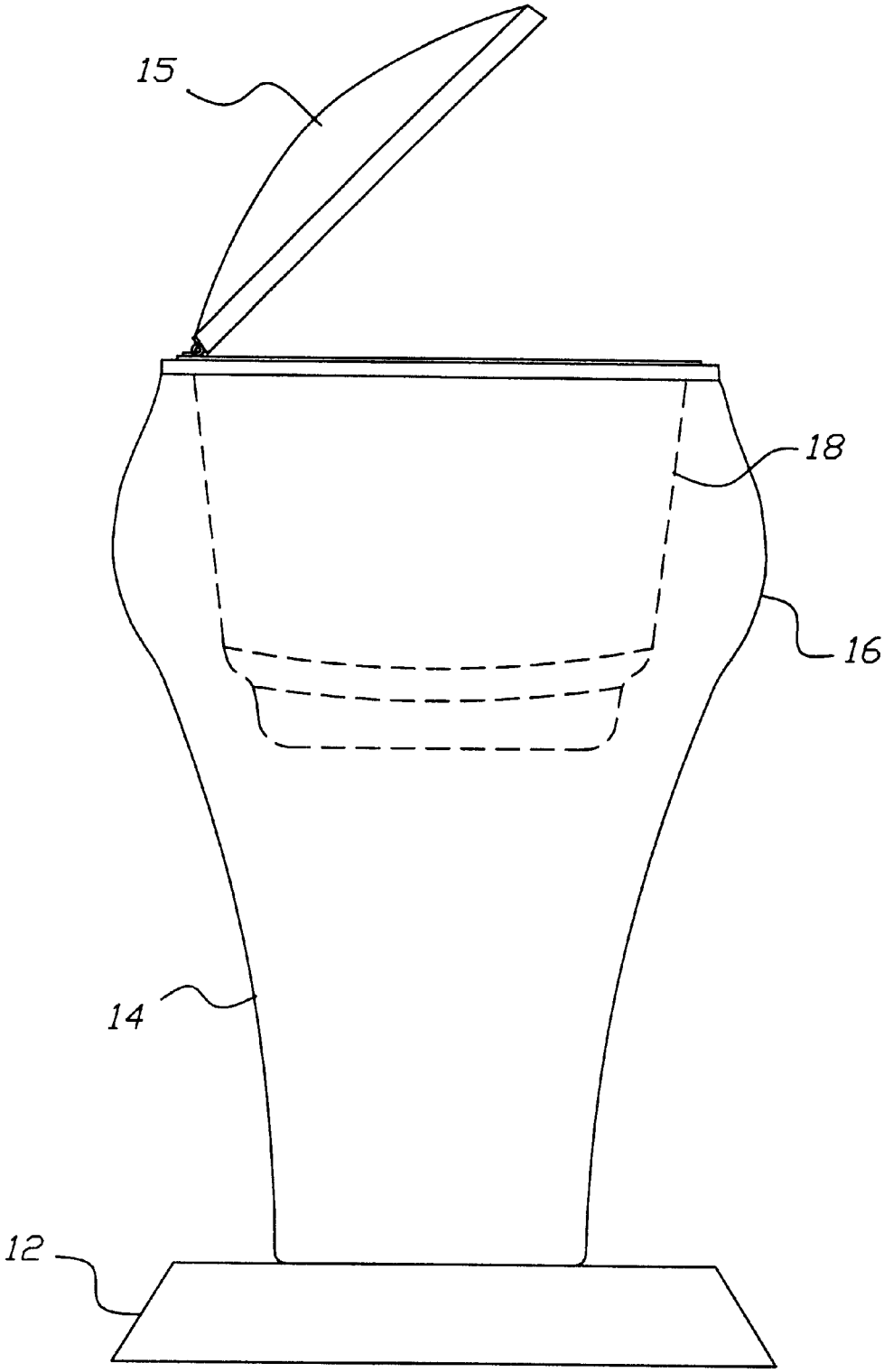
FIG. 3 is the cooler of FIG. 1 with the lid open and showing a reservoir in phantom for holding beverage containers.

Referring to FIGS. 1 and 3, a lid 15 is connected to the top portion of the pedestal and is operable between open and closed positions. Lid 15 is preferably attached to pedestal 14 with a hinge but may be merely supported on a ledge on the top portion of pedestal 14. At the closed position, the lid covers the reservoir thereby blocking access to the beverage containers and preventing warm ambient air from warming the ice and beverage containers. At the open position, access to the beverage containers is permitted.

Figure 4:
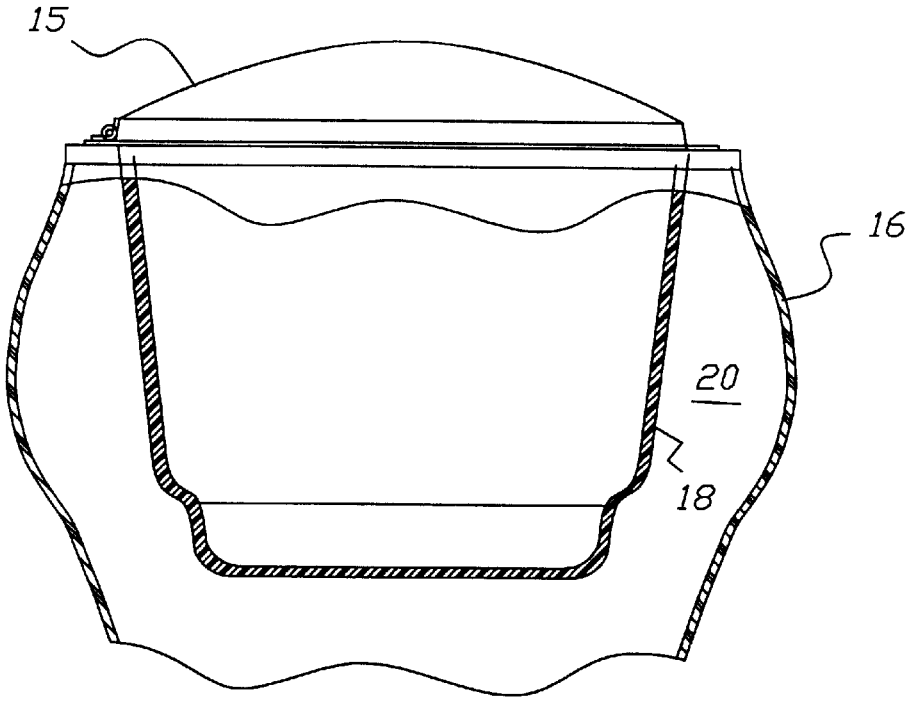
FIG. 4 is the cooler of FIG. 1 with a portion cut away to show the tub and air space.

Referring to FIGS. 3 and 4, the pedestal 14 has an outer sidewall 16 extending from the top of the top portion to the bottom of the bottom portion and an inner sidewall 18 (shown in phantom) extending along the top portion forming the reservoir. An air gap 20 between the inner and outer sidewalls serves as insulation to help maintain the beverage containers and crushed ice. The top portion has a larger transverse dimension than the bottom portion, and the base has a larger transverse dimension than the bottom portion. The top portion has a bell-shaped configuration with a top of the bell truncated.

Figure 5:
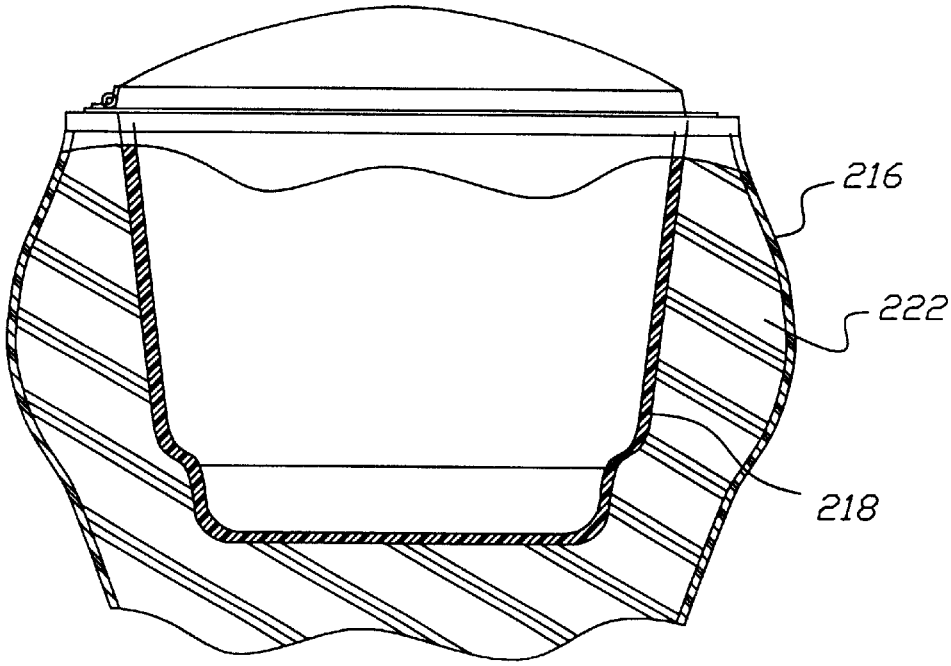
FIG. 5 is another embodiment of a cooler with a portion cut away to show the tub and thermal insulation about the tub.

Referring to FIG. 5, the gap between the outer and inner sidewalls 218, 216 provides a space for thermal insulation 222 to help maintain the beverage containers and crushed ice. Thermal insulation 222 may be attached to the inner sidewall, outer sidewall or both and interposed between the two sidewalls. Preferably, foam, fiberglass or other thermal insulation is interposed between the inner and outer sidewalls and attached to one or both sidewalls.

Figure 6:
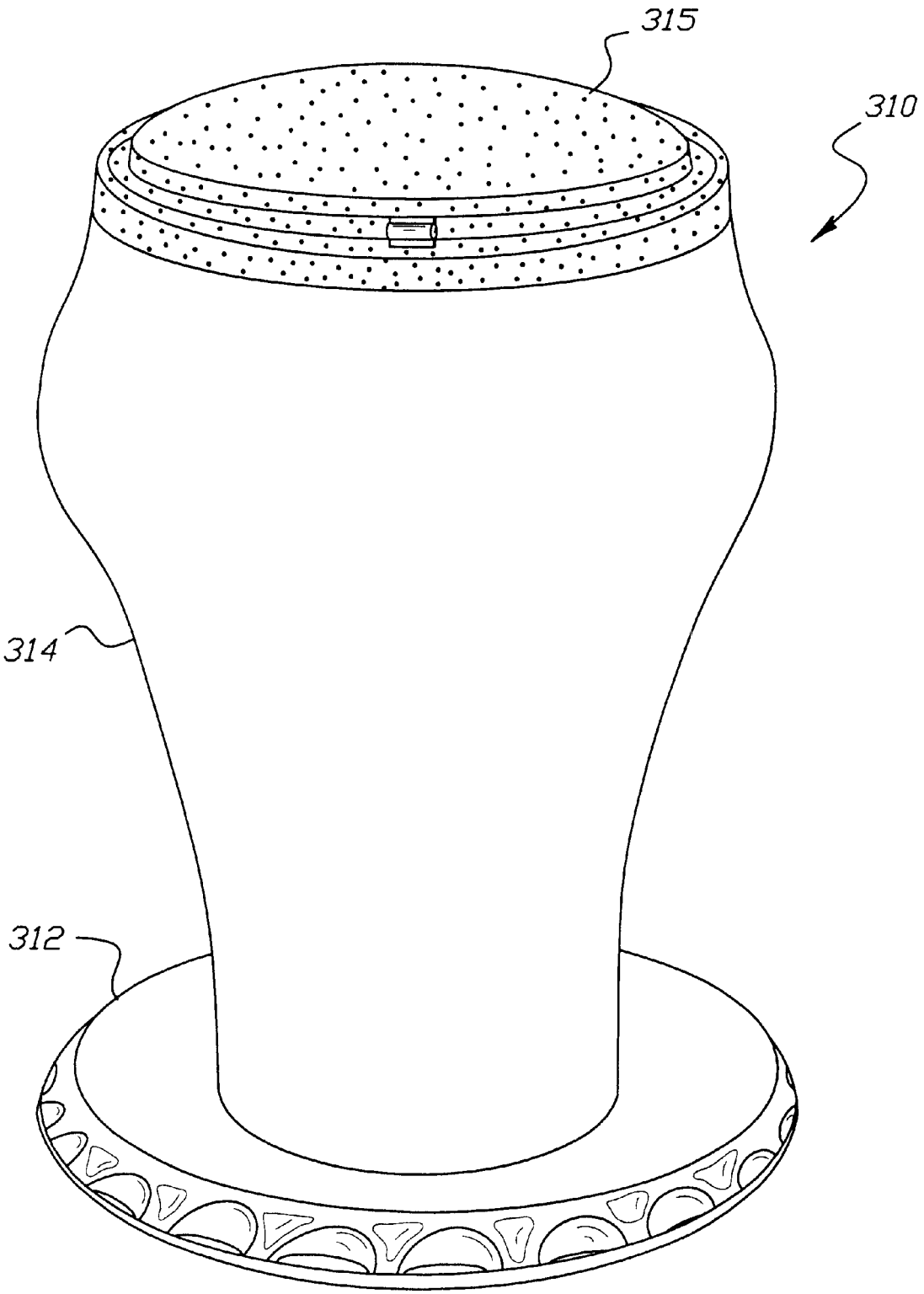
FIG. 6 is a is a front view of another preferred embodiment of a pedestal beverage cooler similar to FIG. 1 but having a frosted lid.

Referring to FIG. 6, a cooler 310 receives a plurality of beverage containers, such as bottles and cans, for display within easy reach of a consumer. The beverage containers are mingled with ice, preferably crushed ice, for cooling the containers. The cooler 310 may have a drain for removing melted ice; but, the more rapid the turnover of beverage containers, the less noticeable is the lack of a drain because some liquid is removed with each container leaving very little liquid to be manually removed.

The cooler 310 has a base 312 and a pedestal 314 mounted on the base 312. As illustrated, the base 312 is a circular disk with a scalloped peripheral edge simulating the appearance of a cap on a bottle. The pedestal 314 is constructed of opaque plastic material. Alternatively, the cooler may have a base and pedestal that are transparent so that the rear of base is visible through pedestal. In that instance, an inner sidewall that forms a reservoir is also visible through outer sidewall of transparent pedestal. The vertical pedestal 314 has a bottom portion fastened to base 312 and upstanding therefrom, and a top portion extending upward from the bottom portion. The top portion of the vertical pedestal defines a reservoir adapted to receive and hold the beverage containers and ice.

Figure 7:
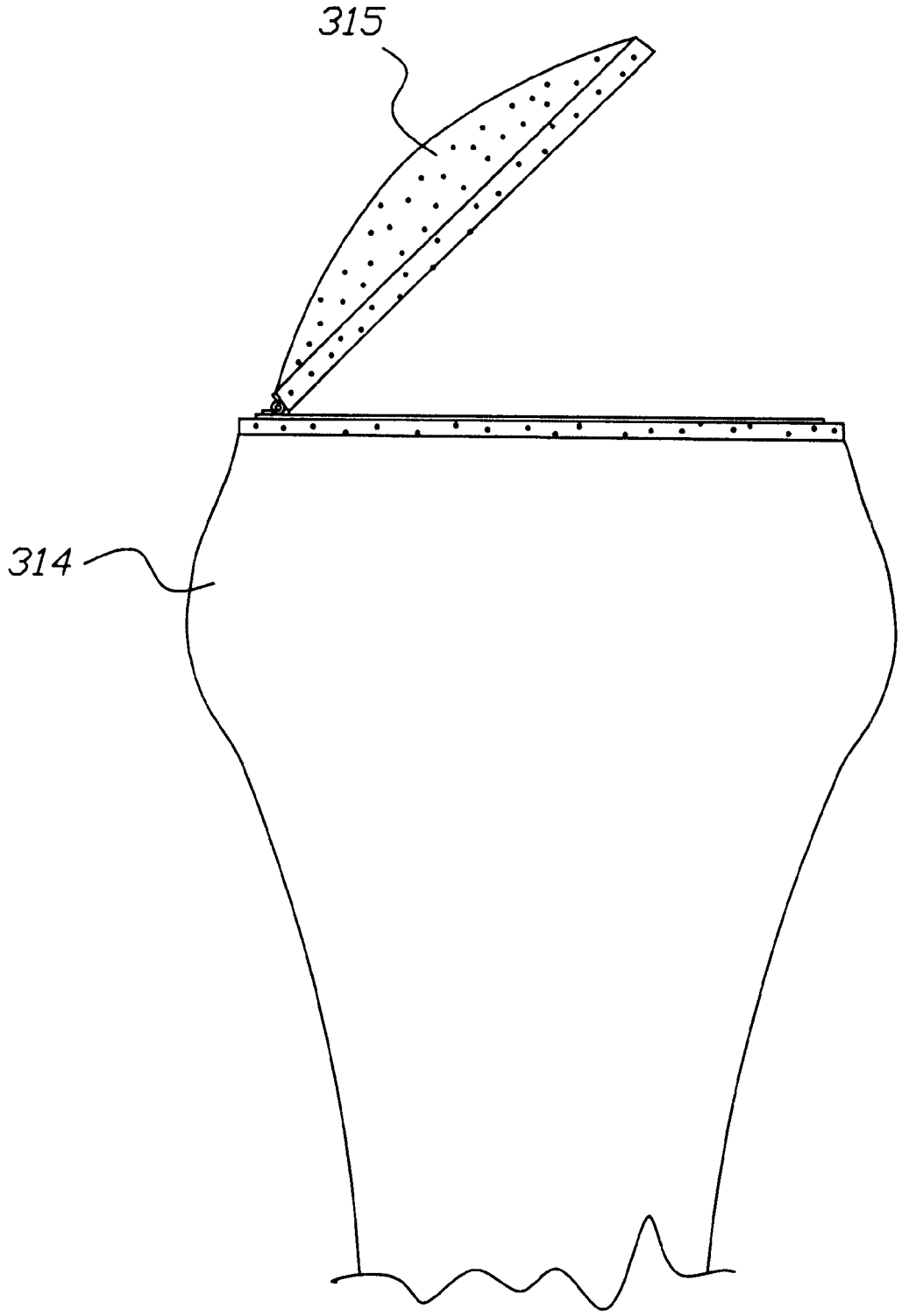
FIG. 7 illustrates the cooler of FIG. 6 with the lid open.

Referring to FIGS. 6 and 7, a lid 315 is connected to the top portion of the pedestal and is operable between open and closed positions. Lid 315 is preferably attached to pedestal 314 with a hinge but may be merely supported on a ledge on the top portion of pedestal. At the closed position, the lid covers the reservoir thereby blocking access to the beverage containers and preventing warm ambient air from warming the ice and beverage containers. At the open position, access to the beverage containers is permitted. Lid 315 is frosted making it translucent so that it always has the same appearance. The appearance of a clear lid will change as the contents of the reservoir change. A frosted lid is translucent rather than either transparent of opaque.

Figure 8:
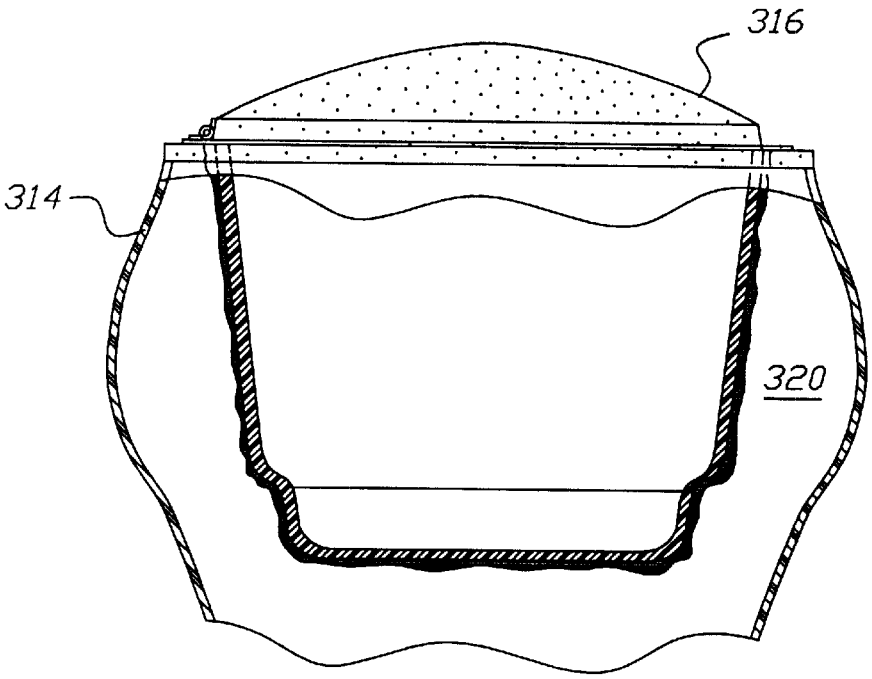
FIG. 8 is the cooler of FIG. 6 with a portion cut away to show the tub and air space.

Referring to FIG. 8, the pedestal 314 has an outer sidewall 316 extending from the top of the top portion to the bottom of the bottom portion, and an inner sidewall 318 extending along the top portion forming the reservoir. An air gap 320 between the inner and outer sidewalls serves as insulation to help maintain the cold temperature of the beverage containers and crushed ice. The top portion has a larger transverse dimension than the bottom portion, and the base has a larger transverse dimension than the bottom portion. The top portion has a bell-shaped configuration with a top of the bell truncated.

Figure 9:
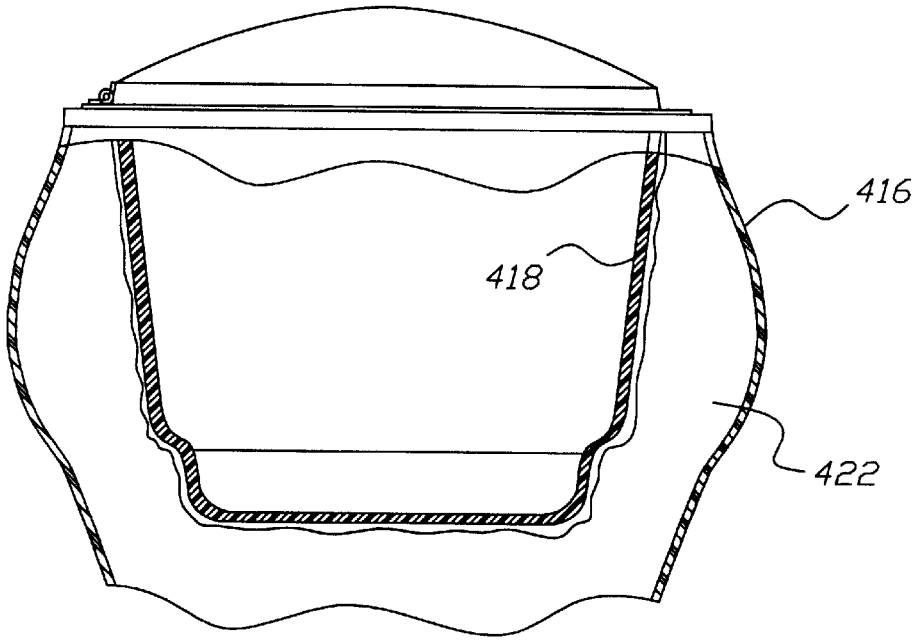
FIG. 9 is another embodiment of a frosted lid cooler with a portion cut away to show the tub and thermal insulation about the tub.

Referring to FIG. 9, the gap between the inner and outer sidewalls 418, 416 provides a space for thermal insulation 422 to help maintain the beverage containers and crushed ice. Thermal insulation 422 may be attached to the inner sidewall, outer sidewall or both and interposed between the two sidewalls. Preferably, foam, fiberglass or other thermal insulation is interposed between the inner and outer sidewalls and attached to one or both sidewalls.

Figure 10:
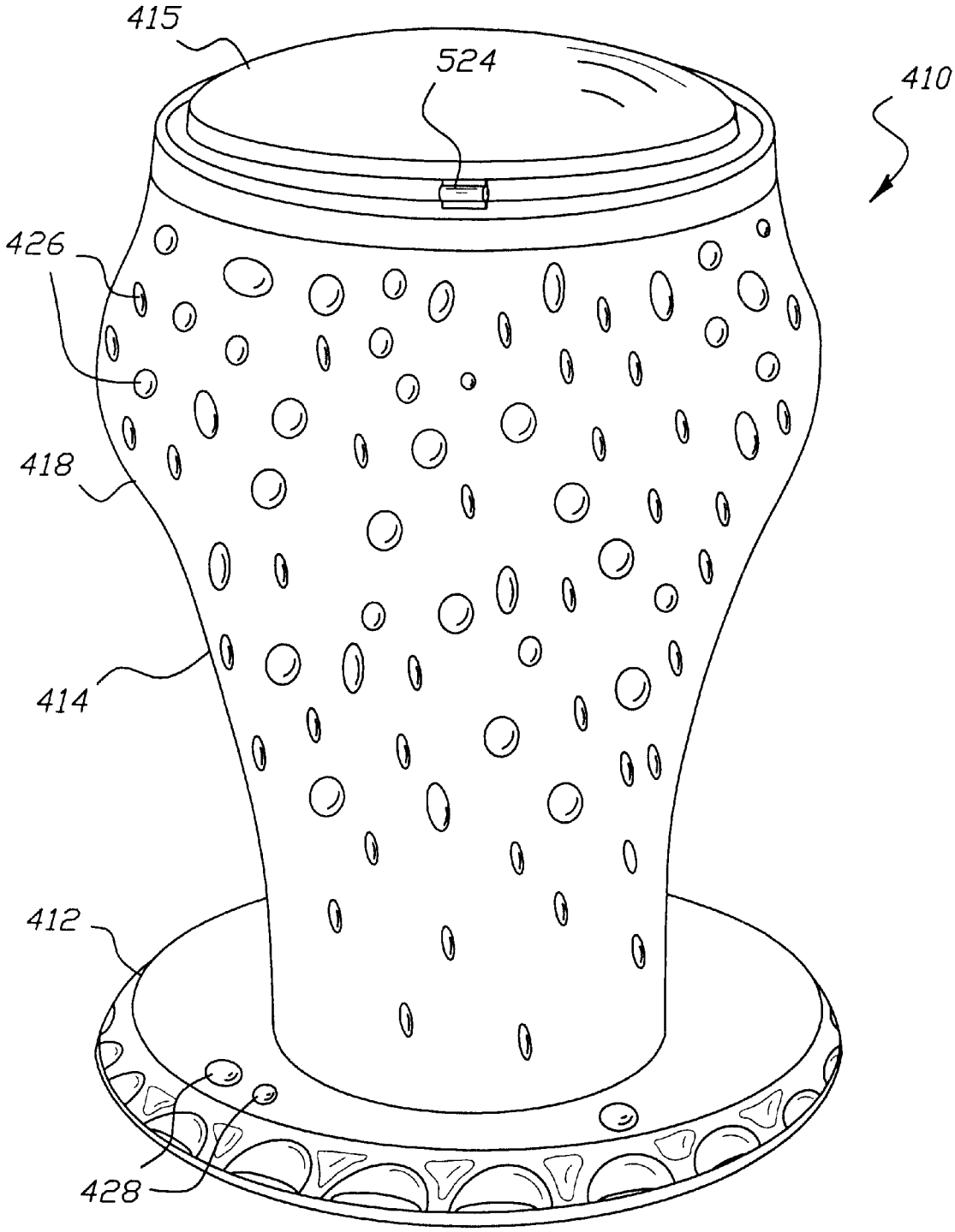
FIG. 10 is a front view of another preferred embodiment of a pedestal cooler with a sweating pedestal.

Referring to FIG. 10, a cooler 510 has a pedestal 514 mounted on base 512 with a lid 515 attached to pedestal 514 with a hinge 524. Pedestal 514 has formed on its outer sidewall 518 a plurality of protrusions 526 to simulate drops of condensation. Base 512 also has a plurality of protrusions 528 to simulate condensation. While protrusions are preferred, depressions could be used, but depressions may have a tendency to accumulate condensation moisture that can puddle and drip giving the appearance of sweat. Of course, sweat implies heat, which is not desirable. As an alternative, instead of protrusions or depressions, condensation droplets can be applied by printing or painting, or a plastic wrap with droplets could be applied. Also, individual condensation droplets in the form of an applique can be used. A clear lid is preferred with the simulated condensation (there will be very little, if any, real condensation because of the insulation) so that the contents of the cooler are visible to heighten desire for the product. With a clear lid, rather than a frosted lid, less time with the lid open is required to make a product selection thereby requiring less maintenance in terms of draining the water and replenishing the ice.

It can now be appreciated that a pedestal cooler has been presented that resembles a soda fountain glass on a bottle cap. The curvilinear sidewall rises gracefully upward from the base and spreads to a wide top portion that houses the reservoir. Heat is inhibited from entering the reservoir through the sidewall by an air space or by thermal insulation such as polyurethane foam. The lid also inhibits the infiltration of heat into the reservoir. Aesthetic appeal is added by making the vertical pedestal transparent enough that the base is visible through the sidewall of the pedestal. Aesthetic appeal is enhanced by decorating the base or pedestal or both in the identifying colors of the beverage container to be cooled therein.

While the invention has been described with particular reference to the preferred embodiments, it will be understood by those skilled in the art that various changes may be made and equivalents may be substituted for elements of the preferred embodiments without departing from invention. For example, while plastic is the preferred material for the cooler, wood or metal could be used. As is evident from the foregoing description, certain aspects of the invention are not limited to the particular details of the examples illustrated, and it is therefore contemplated that other modifications and applications will occur to those skilled in the art. While the reservoir has been described as being integrally formed with the pedestal, it could be a separately formed member, and could be mounted on the base. Also, the pedestal can be adorned with colors or patterns appropriate for the contents or to highlight a particular brand of product, or be adorned with a trademark for a particular brand. It is accordingly intended that the claims shall cover all such modifications and applications as do not depart from the true spirit and scope of the invention.

What is claimed is:

1. A cooler for a plurality of beverage containers, comprising:

a base having a transverse dimension;

a pedestal having top and bottom portions and upstanding from said base, an outer sidewall extending from said top portion to said bottom portion and an inner sidewall fastened to said outer sidewall and extending along said top portion forming said reservoir, said bottom portion being fastened to said base, said top portion defining a reservoir adapted to receive and hold the plurality of beverage containers, said top portion having bell-shaped configuration with a top of the bell truncated, said top portion having a larger transverse dimension than said bottom portion, said base having a larger transverse dimension than said bottom portion and said top portion; and a lid connected Lo said top portion and operable between a closed position at which said lid covers said reservoir blocking access to the beverage containers and an open position at which access to the beverage containers is permitted.

2. A cooler, as set forth in claim 1, including a thermal insulator interposed between said inner and outer sidewalls.

3. A cooler, as set forth in claim 1, including a thermal insulator attached to said inner sidewall and interposed between said inner and outer sidewalls.

4. A cooler, as set forth in claim 1, wherein said outer sidewall is sufficiently transparent that said base is visible through said outer sidewall.

5. A cooler, as set forth in claim 1, wherein said lid is hingedly connected to said top portion.

6. A cooler, as set forth in claim 1, wherein said lid is sufficiently transparent that the beverage containers are visible.

7. A cooler for a plurality of beverage containers, comprising:

a base having a transverse dimension;

a pedestal having top and bottom portions and upstanding from said base, an outer sidewall extending from said top portion to said bottom portion and an inner sidewall fastened to said outer sidewall and extending along said top portion forming said reservoir, said bottom portion being fastened to said base, said top portion defining a reservoir adapted to receive and hold the plurality of beverage containers, said top portion having bell-shaped configuration with a top of the bell truncated, said top portion having a larger transverse dimension than said bottom portion, said base having a larger transverse dimension than said bottom portion and said top portion;

a transparent lid hingedly connected to said top portion and operable between a closed position at which said lid covers said reservoir blocking access to the beverage containers and an open position at which access to the beverage containers is permitted; and a thermal insulator attached to said inner sidewall and interposed between said inner and outer sidewalls.

* * * * *